US010413808B2

(12) United States Patent
Spiridigliozzi et al.

(10) Patent No.: US 10,413,808 B2
(45) Date of Patent: Sep. 17, 2019

(54) ELECTRONIC WORD GAME

(71) Applicants: Shari Spiridigliozzi, Netcong, NJ (US); Robert Driscoll, Florence, MA (US)

(72) Inventors: Shari Spiridigliozzi, Netcong, NJ (US); Robert Driscoll, Florence, MA (US)

( * ) Notice: Subject to any disclaimer, the term of this patent is extended or adjusted under 35 U.S.C. 154(b) by 56 days.

(21) Appl. No.: 15/285,462

(22) Filed: Oct. 4, 2016

(65) Prior Publication Data

US 2017/0095729 A1 Apr. 6, 2017

Related U.S. Application Data

(60) Provisional application No. 62/236,971, filed on Oct. 4, 2015.

(51) Int. Cl.

| | |
|---|---|
| ***A63F 9/24*** | (2006.01) |
| ***A63F 13/00*** | (2014.01) |
| ***G06F 17/00*** | (2019.01) |
| ***G06F 19/00*** | (2018.01) |
| ***A63F 3/04*** | (2006.01) |
| ***A63F 3/00*** | (2006.01) |

(52) U.S. Cl.

CPC ..... *A63F 3/0421* (2013.01); *A63F 3/00643* (2013.01); *A63F 3/00697* (2013.01); *A63F 3/0423* (2013.01); *A63F 2003/00662* (2013.01); *A63F 2003/00826* (2013.01); *A63F 2003/0426* (2013.01)

(58) Field of Classification Search

CPC . A63F 3/00003; A63F 3/00643; A63F 3/0421
See application file for complete search history.

(56) References Cited

U.S. PATENT DOCUMENTS

| | | | | |
|---|---|---|---|---|
| 8,292,689 | B2 * | 10/2012 | Hardin | A63H 33/26 446/477 |
| 2002/0153584 | A1 * | 10/2002 | Frazier | G11C 23/00 257/448 |
| 2006/0154711 | A1 * | 7/2006 | Ellis | G06N 3/004 463/1 |

(Continued)

OTHER PUBLICATIONS

Wikipedia—Sifteo Cubes, Sep. 15, 2015, <https://en.wikipedia.org/w/index.php?title=Sifteo_Cubes&oldid=681095060>.*

(Continued)

*Primary Examiner* — Milap Shah
*Assistant Examiner* — Jason Pinheiro
(74) *Attorney, Agent, or Firm* — Benjamin Appelbaum

(57) ABSTRACT

An electronic word game uses a plurality of tiles and electronic rack to make one or more words. The tiles are received in a plurality of receivers in the rack enabling electronic communication between the tiles and rack. Each tile includes a display screen, a microprocessor, and communication means. The rack includes an on-off switch, microprocessor, speaker, power source, and a means of communicating with each tile. A capacitor in each tile provides power to keep the display screen on temporarily after the tile is removed from the rack. The microprocessor includes a means for selecting a word to be spelled based on the number of tiles selected to play the game (between 3 and 7 tiles), a means for determining whether a word has been formed, and a means to signal the player that a word has been formed.

16 Claims, 11 Drawing Sheets

(56) References Cited

U.S. PATENT DOCUMENTS

| | | | | |
|---|---|---|---|---|
| 2006/0172787 | A1* | 8/2006 | Ellis | A63F 13/10 463/1 |
| 2006/0215476 | A1* | 9/2006 | Owen | G09B 1/34 365/230.03 |
| 2009/0310065 | A1* | 12/2009 | Dunn | G02F 1/133603 349/69 |
| 2012/0007870 | A1* | 1/2012 | Owen | G09B 1/34 345/473 |
| 2013/0259150 | A1* | 10/2013 | Ruland | A63F 5/00 375/267 |
| 2015/0238869 | A1* | 8/2015 | Canessa | A63F 13/02 463/43 |

OTHER PUBLICATIONS

Bergen, Jennifer, "Sifteo intelligent cubes use NFC to interact with each other", Geek.com, May 10, 2013, <https://web.archive.org/web/20130510031408/https://www.geek.com/games/sifteo-intelligent-cubes-use-nfc-to-interact-with-each-other-1411787/>.*

* cited by examiner

SIDE VIEW:

SP1
SPEAKER
AUDN
AUDP
PVDD
PVSS
VDD1
VSS1
ROSC
VDD2
VSS2
VDD3
VSS3
IOD7
IOD6
IOD5
IOD4
IOD3
IOD2
IOD1
IOD0
/RESET
TEST
IOB7
IOB6
IOB5
IOB4
IOB3
IOB2
IOB1
IOB0
IOC7
IOC6
IOC5
IOC4
IOC3
IOC2
IOC1
IOC0
*1
GPC1116OC
PWR_CTRL_2
PWR_CTRL_1
SW1
ON/OFF
VDD
R4
75k
C4
104
C6
104
C7
104
C3
104
C5
104
R13
1K
R12
1K
R11
1K
R10
1K
R9
1K
R8
1K
R7
1K
R6
1K
D7
D6
D5
D4
D3
D2
D1
D0
U1
CE1239P33M
SSA
Vin
Out
C2
22u
C1
22u
B1
4.5V
VBAT

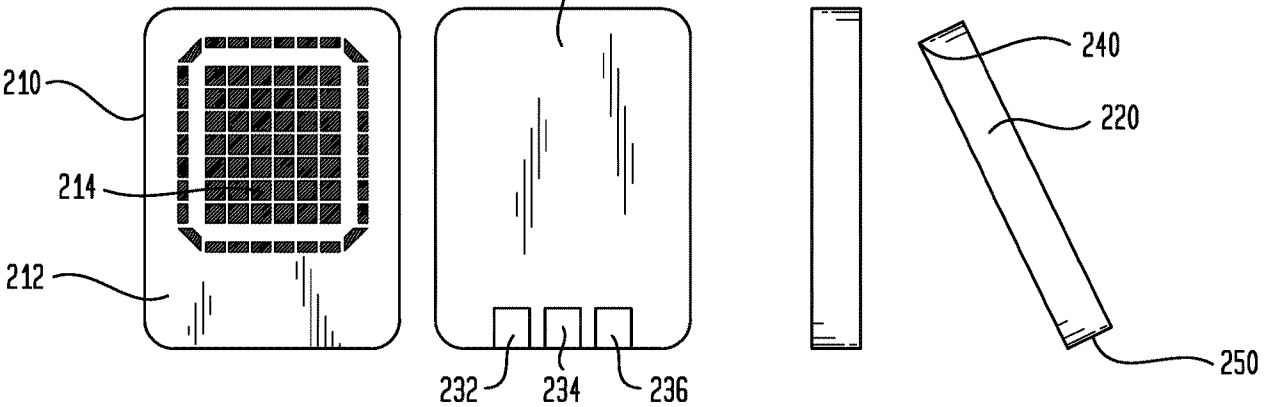
FIG. 5
FRONT BACK SIDE_STRAIGHT AND TITLED
6x7 DOT MATRIX FOR SHOWING ONE LETTER
FIG. 6
LETTER FONT:
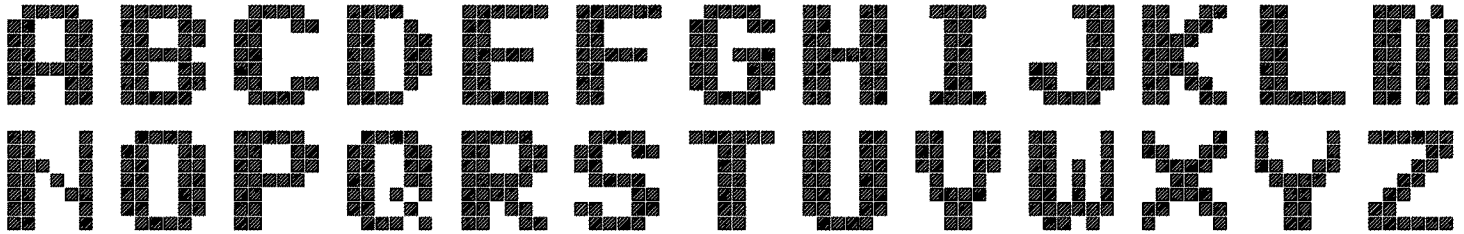

Rack Race

- Find a 7 letter word
- Earn Bonus Points
- Plus a new set of 7 letters

Rack Race

- Can you find a 7 letter word?
- Smart database leads to at least one for each set of letters

ELECTRONIC WORD GAME

CROSS-REFERENCES TO RELATED APPLICATION

This application claims the benefit of U.S. Provisional Application for Patent Ser. No. 62/236,971, filed 4 Oct. 2015, by these inventors, and whose content is incorporated by reference herein in its entirety.

FIELD OF THE INVENTION

Embodiments of the present invention relate to the art of electronic word games, specifically a game that uses a plurality of electronic tiles to make one or more words on an electronic rack. The tiles are received in a plurality of slots formed in the rack, such that the tiles are in electronic communication with the rack. Each tile includes a display screen, a microprocessor, and means for communicating with the rack. The rack includes an on-off switch, a microprocessor, a speaker, a power source, and a means of communicating with each tile. A capacitor in each tile provides power to keep the display screen on temporarily after the tile is removed from the rack. The rack microprocessor includes a database of words, means for identifying each tile and selecting the letter to be displayed on each tile during a game, a means for selecting a word to be spelled based on the number of tiles selected to play the game, a means for determining whether a word has been formed, and a means to signal the player that a word has been formed. When all the tiles in the rack have been used to form a word, the game is over, a score is determined, and a new game, with a new word and new letters, can begin A game can be played with as few as three and as many as seven tiles.

BACKGROUND OF THE INVENTION

Various types of word games are known, with word games involving the use of a board and tiles, and generally need more than one player. Certain of these games may be bulky, and require the use of a large playing space, such as a table top or floor, for game play to occur. Smaller and more portable versions of many of these games have been developed, and electronic versions developed for play utilizing computers, portable electronic devices, tablet computers, smart phones and the like.

Embodiments of the present invention comprise an electronic word game utilizing an electronic rack and set of game tiles with which a player can challenge his ability to make a word within a specified time period. All power for the game and the video display on the tiles comes from the rack; the tiles include a capacitor to enable the tiles' display to remain on while the tile has been removed from the rack as the player moves the tile during word formation.

BRIEF SUMMARY OF THE INVENTION

An object of the present invention is to provide an electronic word game that utilizes a plurality of letter tiles and electronic rack for holding the letter tiles and for playing the game.

Another object of the present invention is to provide an electronic word game in which the tiles contain a Liquid Crystal Display ("LCD") screen that displays a letter.

Another object of the present invention is to provide an electronic word game in which the letter displayed on the LCD screen is controlled by the electronic rack.

An electronic word game uses a plurality of tiles and electronic rack to make one or more words. The tiles are received in a plurality of receivers in the rack enabling electronic communication between the tiles and rack. Each tile includes a display screen, a microprocessor, and a means of communicating with the rack. The rack includes an on-off switch, microprocessor, speaker, power source, and a means of communicating with each tile. A capacitor in each tile provides power to keep the display screen on for a brief period after the tile is removed from the rack. The microprocessor includes a means for selecting a word to be spelled based on the number of tiles selected to play the game (between 3 and 7 tiles), a means for determining whether a word has been formed, and a means to signal the player that a word has been formed.

BRIEF DESCRIPTION OF THE SEVERAL VIEWS OF THE DRAWING

FIG. 3 is a representation of the rack.

FIG. 4A shows the power supply, and power flow to the rack.

FIG. 4C shows power flow to each of the receiver spaces on the rack.

FIG. 5 shows front and back views of a tile, and side views of a tile when in an upright (straight) and tilted position. The back view shows the contacts of the tile.

FIG. 6 shows the appearance of the letters that will be displayed on the tile display.

DETAILED DESCRIPTION OF THE INVENTION

Figure 1:
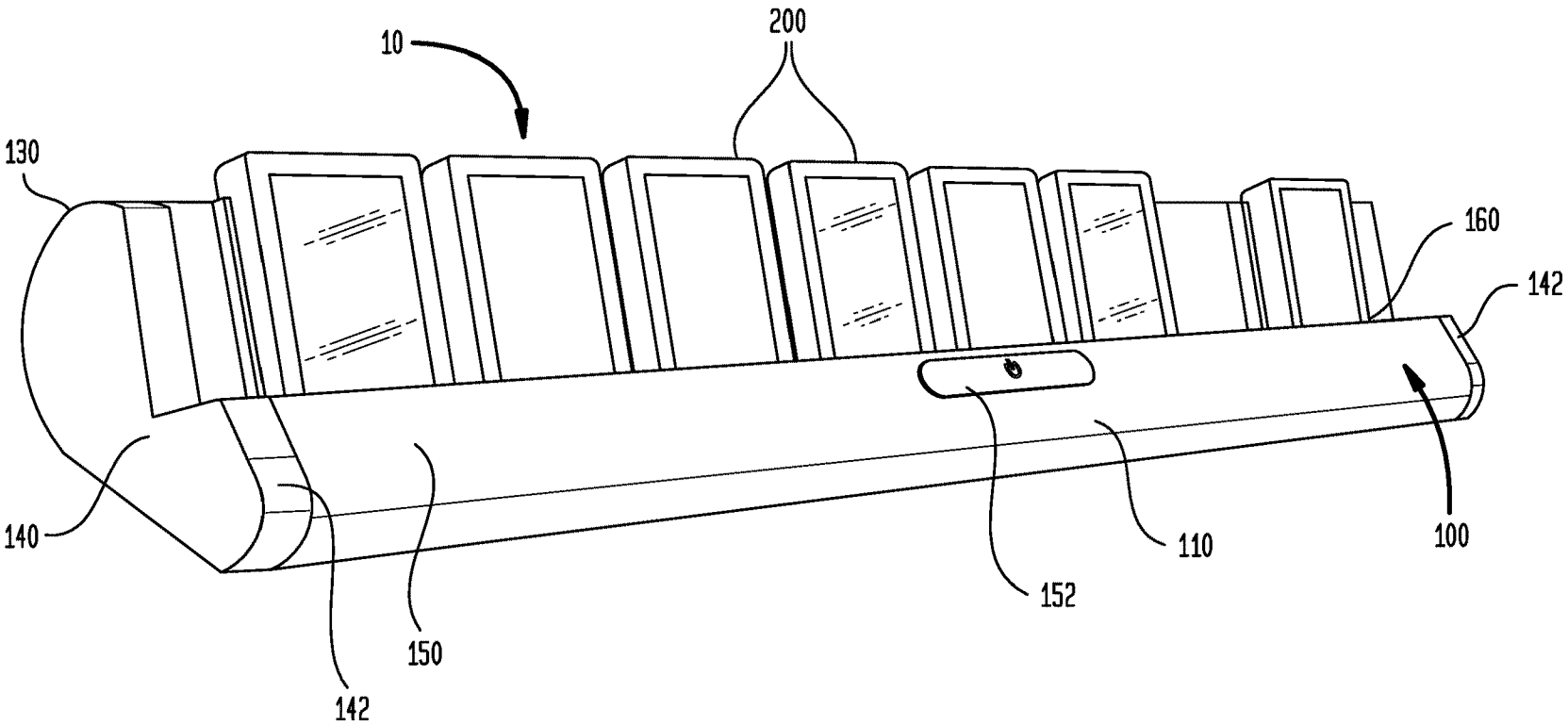
FIG. 1 is a plan view of an embodiment of the present invention.

An embodiment of the electronic word game, reference numeral 10, is shown in FIG. 1. The word game 10 comprises a rack 100 and a plurality of tiles 200. The rack 100 includes a bottom surface 110, a back surface 130, a pair of sides 140, and a front surface 150 that includes a plurality of tile receiver surfaces 160.

The rack 100 includes an on/off switch 152 which can be either a button or toggle switch. In the embodiment shown (FIG. 1), the on/off switch 152 is a push button switch.

The sides 140 each include a trim piece 142, which provides a finished appearance to the rack 100. The sides 140 also hold the rack 100 together, the sides 140 being added to the rack after the circuitry (shown in FIGS. 4A-4D) has been positioned within the rack 100 during manufacture.

Figure 9:
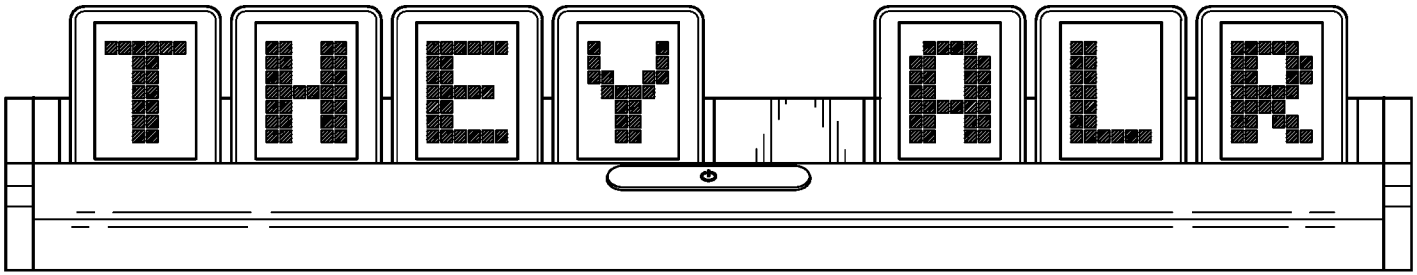
FIG. 9 shows use of the additional receptor space on the rack to separate tiles.
Figure 10:
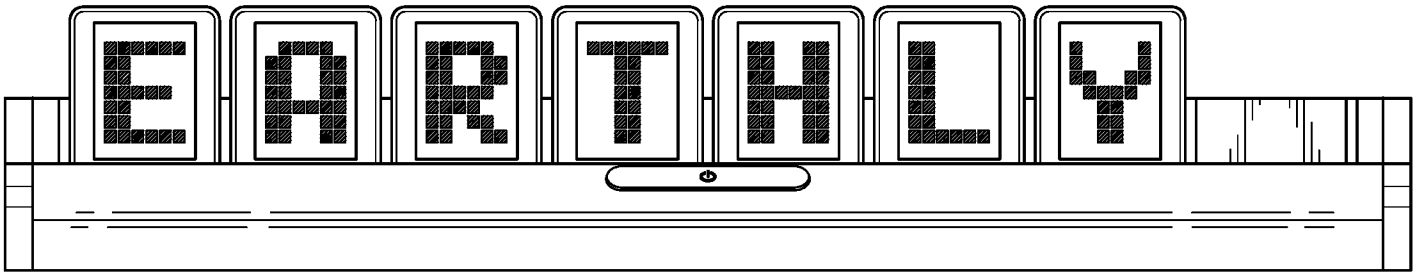
FIG. 10 shows a seven letter word, and describes actions at the end of a game.

In the embodiment shown, the rack 100 comprises eight receiver surfaces 160, even though the game is provided with seven tiles 200. The eight receiver surfaces 160 provide an extra position for the player to insert a tile, for example, to act as a spacer, or allow the player to move tiles along the length of the rack while playing (see, for example, FIG. 9).

The contacts 162, 164, and 166 in the receptor surfaces 160 function for grounding, data transmission, and a power transmission between the rack 100 and the tiles 200. The construction of the rack 100 is such that the contacts 232, 234, and 236 of the tiles 200 will mate with the corresponding contacts 162, 164 and 166 of the rack. The connection between the tiles 200 and the rack 100 should be firm, but not so strong that it becomes difficult for the tiles to be readily maneuvered by the player, especially in view of the game being a timed game. The construction of the receiver surfaces 160 in the rack 100 includes a means to help guide the tiles 200 into position on the rack 100.

The rack 100 could be manufactured from materials such as metal, wood, or plastic. In most embodiments, plastic is suitable because of the ease of manufacturing and assembling the rack.

Figures 4A, 4B:
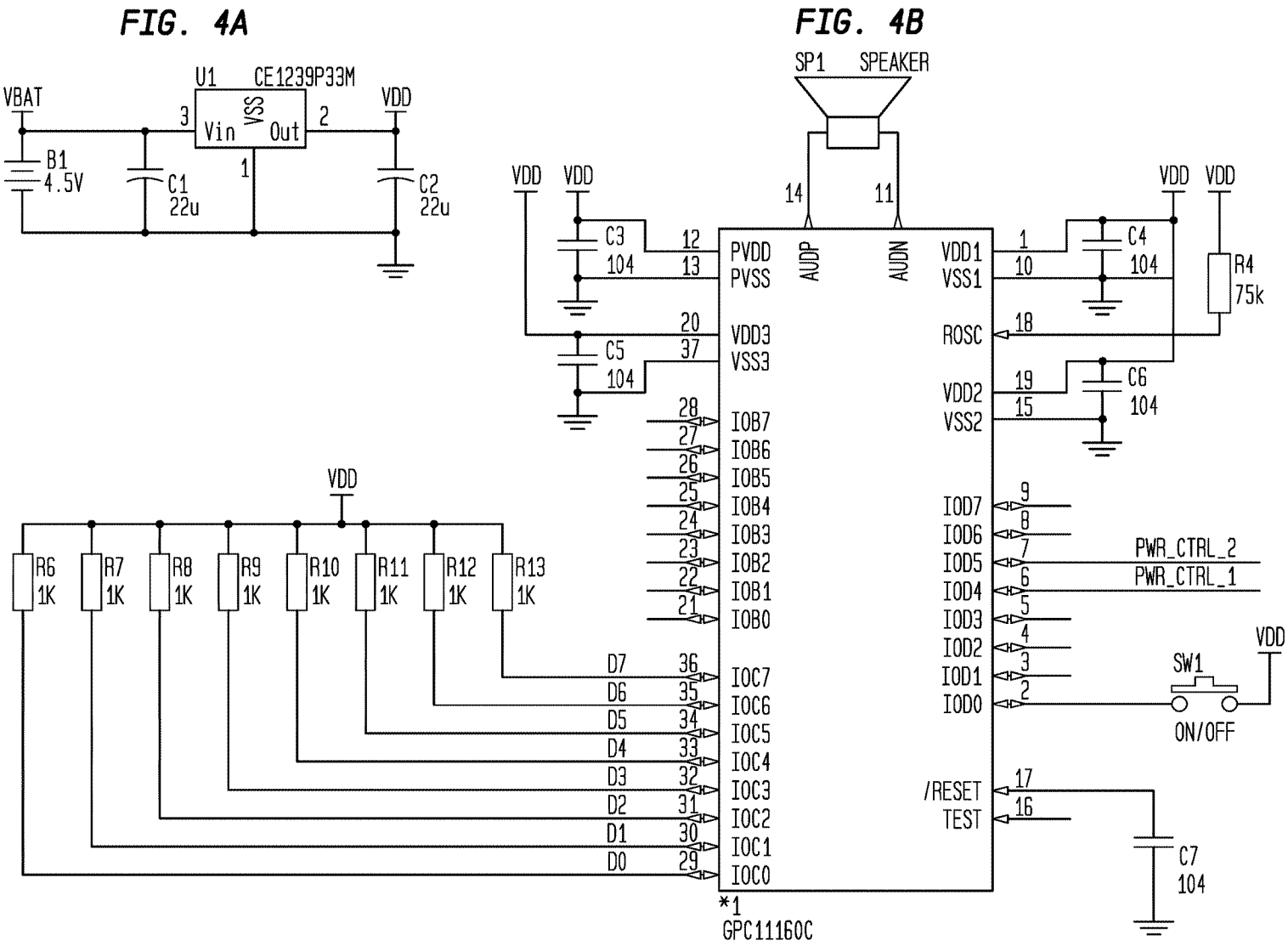
FIGS. 4A and B are schematics of the base.
FIG. 4B is a schematic of the electronics of the rack.
Figure 4C:
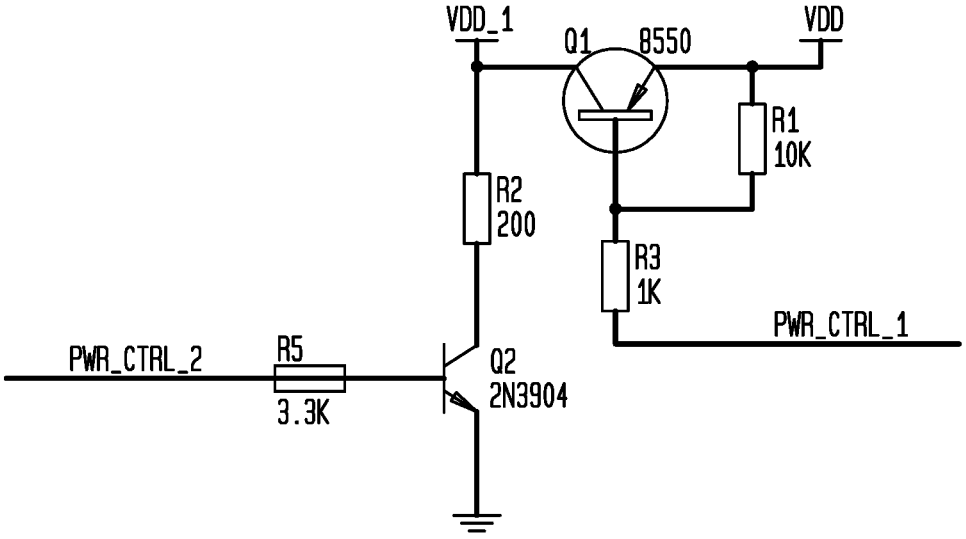
FIGS. 4C and D are schematics of the base.
Figure 4D:
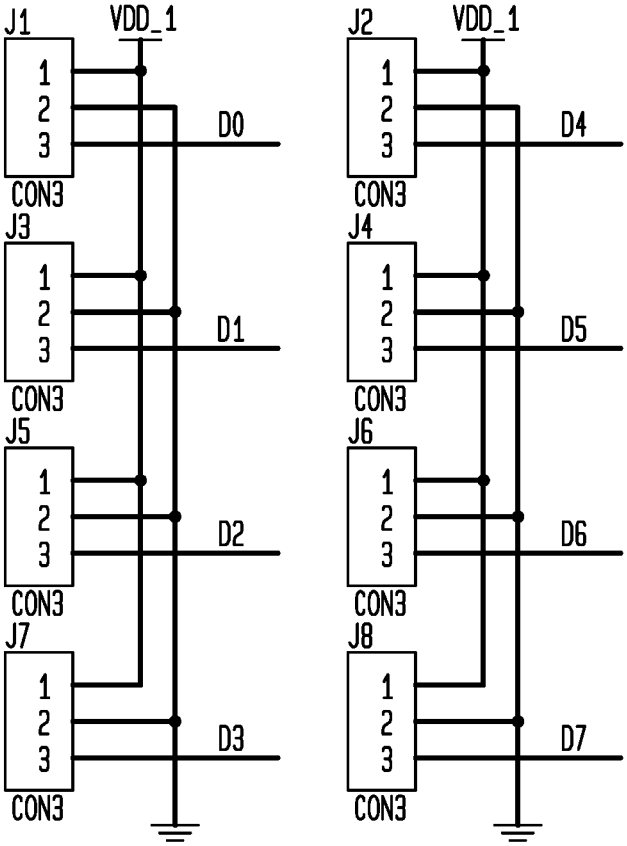
FIG. 4D shows flow to the connectors at each receiver space on the rack.

Electronics:

The electronics of the rack are illustrated in FIGS. 4A-4D. FIG. 4B illustrates the main circuitry of the rack, on/off switch 152 and the presence of a speaker 170. The game is designed to be battery powered (shown in FIG. 4A). The electronics connecting to the receiver surfaces and the contacts 162, 164 and 166 at each receiver surface 160 are shown in FIG. 4D.

Another embodiment (not shown) could include an adapter to allow the game system 100 to operate off of the local current instead of or in addition to being powered by a battery. Such an adapter could allow for use of alternating current ("AC"), such as used in North America, or 220 volt operation or other power types used throughout the world. Such alternate embodiment would include a plug in the back or side of the rack, and an appropriate connection so that the plug is in electrical communication with the circuitry of the rack.

Figure 2:
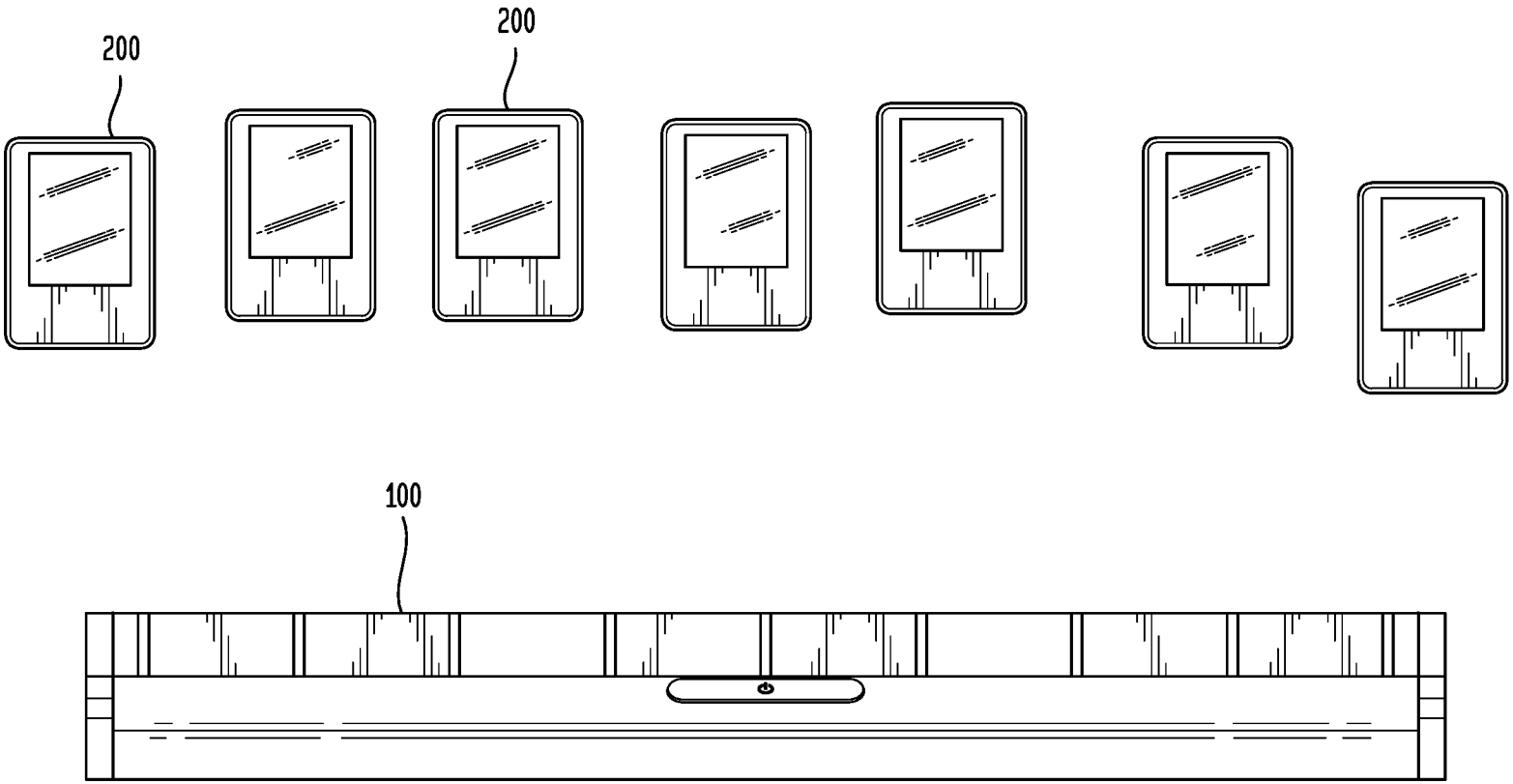
FIG. 2 is a frontal view showing the tiles separately from the rack.
Figure 3A:
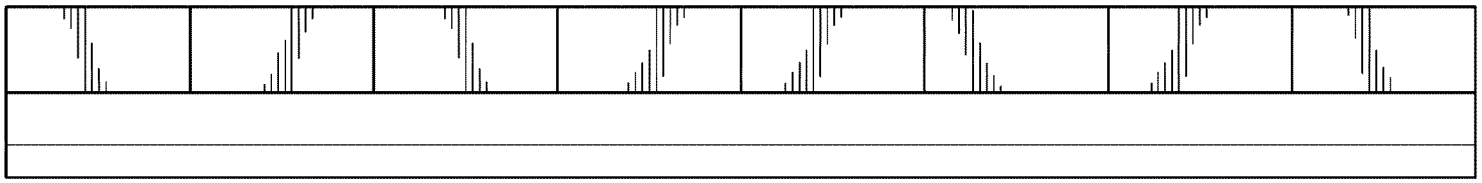
FIG. 3A is a front view of an embodiment of the rack.
Figure 3D:
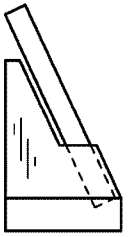
FIG. 3D is a side view of the embodiment shown in FIG. 3C.
Figure 3B:
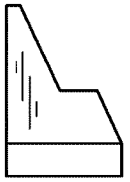
FIG. 3B is a side view of the embodiment shown in FIG. 3A.
Figure 3C:
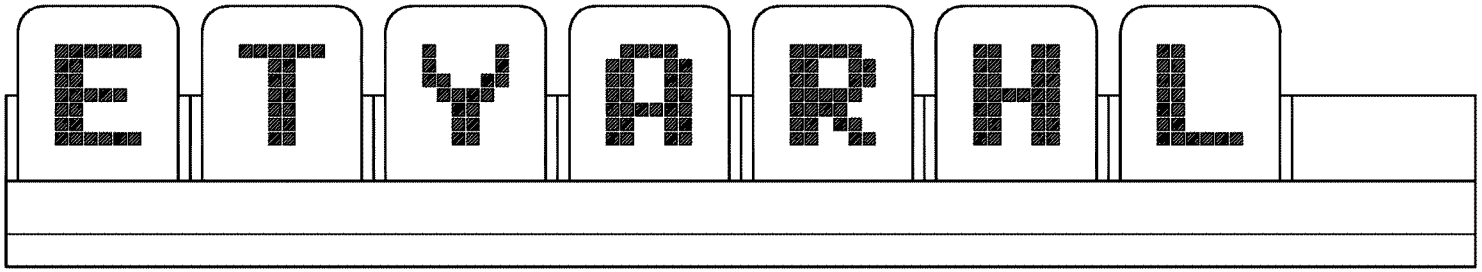
FIG. 3C shows the rack of FIG. 3A with several tiles.

As shown in FIGS. 2 and 5, the tiles 200 include a front face 210, sides 220, back side 230, top 240 and a bottom 250. Front face 210 includes a rim 212 and a display screen 214. In embodiments, the display screen 214 is a Liquid Crystal Display ("LCD"). In alternate embodiments, the display could be a light emitting diode ("LED") display, an organic light emitting diode ("OLED") display, or any type of display now known or to be developed in the future that is capable of fitting into the tile and communicating with the tile 200, the tile microprocessor 280 and the rack microprocessor 180.

Figure 7:
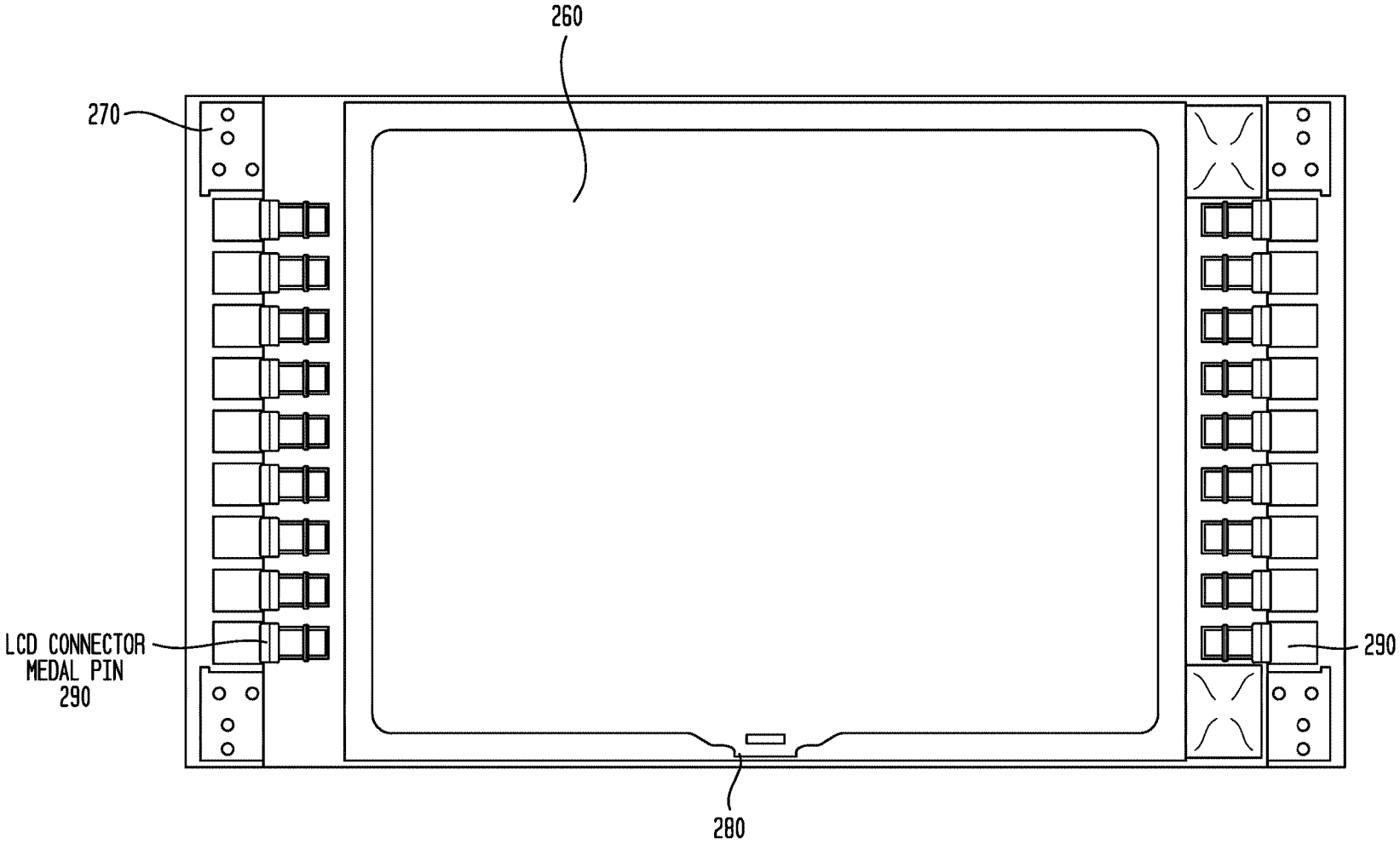
FIG. 7 is a view of the LCD display and its connection to the circuit board of a tile.

FIG. 7 is a cut away view of the tile 200 showing the LCD screen 260 and its connection to a printed circuit board ("PCB") 270 onto which the LCD 260 and other electronic components are attached. Tile microprocessor 280 is visible beneath the LCD screen 260 and above the circuit board 270. A plurality of metallic pins 290 connect the LCD screen 260 directly to the circuit board 270.

Figure 8:
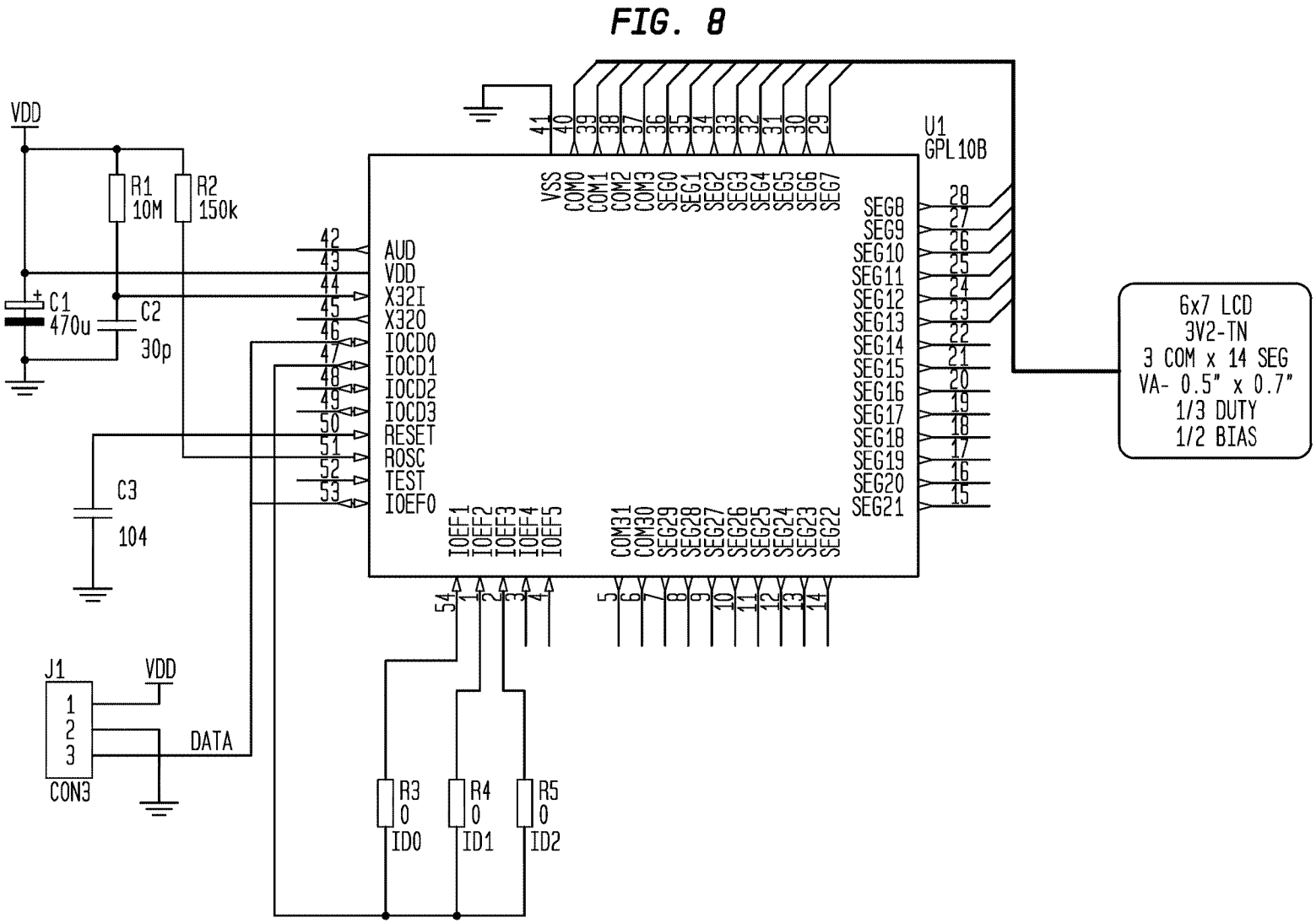
FIG. 8 is a schematic of the tile.

FIG. 8 is a schematic of the electronics of the tile 200. An embodiment of the tile 200 does not include batteries The rack 100 transmits power to each of the tiles 200 via metal to metal contacts 232, 234 and 236 (FIG. 5). The contacts between the tile 200 and the rack 100 are also used for communications, so that the rack can identify each tile, and as a ground. As will be described further, the electronics in the rack 100 control which letter is to be displayed on each tile. The tiles 200 include a capacitor (FIG. 8, C1 and C2), so that the letter will remain displayed on the LCD 260 for about 10 seconds after the tile 200 has been removed from the rack 100.

The LCD 260 is programmed to display a letter in a 6×7 dot matrix pattern (see FIG. 5, left hand panel), and FIG. 6 shows how the alphabet will appear when displayed on the LCD 260.

In other embodiments, the tile 200 utilizes an LCD segment to form the rim 212, and the tile microprocessor 280 is programmed to cause the LCD segment in the rim (rather than the LCD screen 260) to flash when a correct word is formed.

Database:

The database 190, which is stored in the rack microprocessor 180, will include about 900 sets of 7 letters that will lead to the formation of about 900 seven-letter words (Main Word List). Depending upon the language used for the game (for example, English compared to Spanish), the words should be those that are considered as commonly known in that language. The database should also accommodate differences in the spelling of certain words, such as, for example only and not a limitation, "labor" in American English compared to "labour" as used in Canada, Britain and Europe, The database 190 will include most every 3 to 7 letter word that can be spelled from these 7 letter words.

The database 190 will also include about 600 well known (as described in the previous paragraph) 6 letter words that can be spelled with the letters from the main seven-letter word database (insuring that most all of the smaller words for the 6 letters will be in the database.). The database will also include about 850 well known (as described in the prior paragraph) 5 letter words, 950 well known (as described in the prior paragraph) 4 letter words and 350 well known (as described in the prior paragraph) 3 letter words. When a game is played with just 3 tiles, there will be no smaller words (2 letters or fewer) to look up in the database. Thus, in any 3 letter game the microprocessor 180 will only look for 3 letter words. When the game selects letters from the database for the player it should only select words from the Main Word List. The database is programmed to identify and separate the Main Words from the other words in the database. In embodiments, the number of words in the database can be increased, within the capacity of the microprocessor being employed.

Figure 11A:
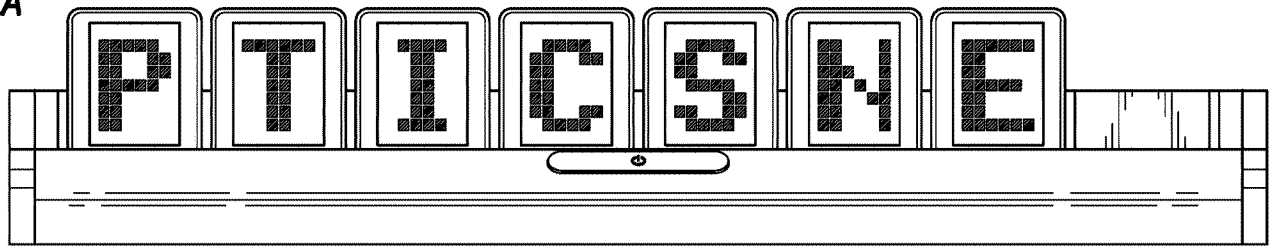
FIG. 11A shows a set of letters for the game.
Figure 11B:
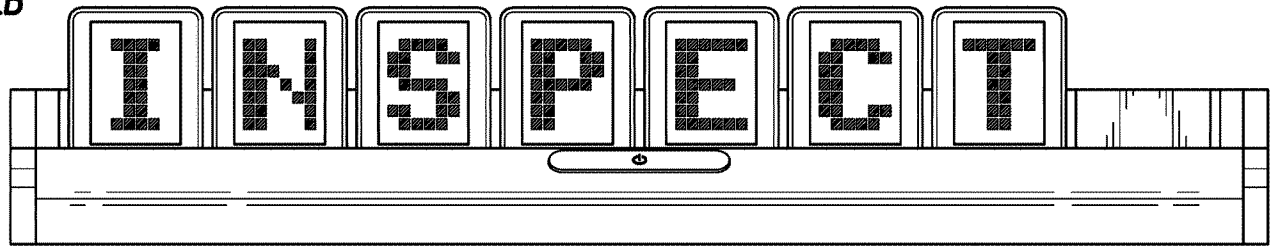
FIG. 11B illustrates a seven letter word using the letters shown in FIG. 11A.

Game Play:

To start the game, the player inserts a number of tiles 200, between 3 and 7 tiles, into the receptors 160 on rack 100, and depresses the on/off switch 152. The rack microprocessor 180 communicates with the tiles 200 and determines the number of tiles on the rack. Each tile 200 is assigned a unique identification code to enable the rack to know the location of any given tile on the rack. The rack microprocessor 180 randomly selects a set of letters from the Main Word List in the database 190 based on the number of tiles being used for the game. The rack microprocessor 180 scrambles the letters so that when they are displayed on the game tiles, they do not spell a valid word for that number of tiles when displayed. The scrambled letters are then assigned to the tiles 200, and communicated to the tiles 200 through the contacts 162, 164 and 166 in the receiver surfaces 160 and the corresponding contacts 232, 234 and 236 on the tiles, causing the LCD display 260 to display the assigned letters (see, for example, FIGS. 8 and 11).

The microprocessor 190 transmits a NEW LETTER signal to the tiles 200, causing the tiles' LCD 260 to flash twice to indicate that the game has been started, and that it is time to play. In embodiments, the game is a timed game and the player has a specified time period to spell a valid word before time expires and the game is over. The time period can range from about 15 seconds to about 5 minutes. In other embodiments, the time period can range from about 30 seconds to about 5 minutes. In other embodiments, the time period can range from about 30 seconds to about 2.5 minutes. In other embodiments, the time period can range from about 30 seconds to about 2 minutes. In other embodiments, the time period can range from about 30 seconds to about 1 minute. In yet another embodiment, the time period is about 30 seconds.

The player then moves one or more tiles 200 on the rack 100 to form a word, and each time a valid word is spelled, the microprocessor 190 signals the tiles to flash twice with a VALID WORD signal. The type of flash for a VALID WORD signal is different from that of a NEW LETTERS signal so the player will know that the VALID WORD flash indicates that a correct word has been formed, and not to be confused into thinking that either the game is over or new letters are being provided. Each valid word will score points based on the length of the word, as will be described in another section. If the timer expires (for example, 30 seconds without a word having been formed), the microprocessor will signal the tiles so that all of the tiles will flash with a TIME OUT signal. The TIME OUT signal may also include an audible signal through the speaker to signal the end of a game. (Again, the type of flash for a TIME OUT signal will be different from that of the NEW LETTERS or VALID WORD flash so as not confuse the player). In embodiments, an audible warning could also accompany either one or all of the NEW LETTERS, VALID WORD or TIME OUT signals.

A game will continue as long as a valid word has been spelled during the specified time period. Each time after a new valid word has been spelled, the timer will be reset by the microprocessor, and the game will continue. The exception to this timer reset is when that word was previously spelled from the same set of letters.

Once the game timer has expired, the rack microprocessor 190 will wait a specified period for the player to place the number of starting tiles 200 on the rack in consecutive receiver surfaces 160. The time period can range from about 15 seconds to about 5 minutes. In other embodiments, the time period can range from about 30 seconds to about 5 minutes. In other embodiments, the time period can range from about 45 seconds to about 2.5 minutes. In other embodiments, the time period can range from about 45 seconds to about 2 minutes. In other embodiments, the time period can range from about 45 seconds to about 1 minute. In yet another embodiment, the time period is about 45 seconds. Placing the starting tiles is consecutive slots on the rack enables the rack microprocessor to determine that tiles are in position and that a new game is ready to be started.

Once the tiles 200 are in place the rack microprocessor 190 will flash the main word from the database that can be spelled with the full number of letters (selected at the start of the game) five times with a MISSED WORD signal. The game will then display the player's score and flash it twice with a GAME OVER signal. The game will continue to display the score for about 45 seconds and then go into a sleep mode. If the on/off switch 152 is pressed, a new game will start. If, however, the on/off switch 152 is held for 2 seconds, the game will go into sleep mode.

Scoring:

Each time a new valid word is spelled, the player's score will be increased based on the number of letters in the word. A five letter word will receive a higher score than a three letter word. If a valid word is spelled a second time from the same set of letters, it will not be scored (the letters in the word will still flash to let the player know that a valid word has been spelled, but the game will play a NO SCORE signal).

Some examples of scoring are described below. These are representative for a single game, but the microprocessor 190 could be programmed to increase the score in arithmetic increments (such as shown in Example 1) or in, for example, a geometric or logarithmic increment. A four letter word may score twice that of a three letter word, a five letter word twice that of a four letter word, a six letter word twice that of a five letter sword, and a seven letter word twice that of a six letter word.

Example 1 a. 3 letter words=1 point
b. 4 letter words=3 points
c. 5 letter words=6 points
d. 6 letter words=10 points
e. 7 letter words=15 points Example 2

1. 3 letter words=1 point
2. 4 letter words=2 points
3. 5 letter words=4 points
4. 6 letter words=8 points
5. 7 letter words=16 points The microprocessor 190 will keep track of the score, and may cause the score to be announced through the speaker 195 at the end of the game. The game is ended either after all of the tiles have been used to form words, or after a specified time period has elapsed, as previously described. The time period can range from about 15 seconds to up to about 5 minutes or longer, as has been stated in a prior section of this specification. In one embodiment, the time period is about 30 seconds. Table 1 summarizes the various types of signals that may be displayed during the course of a game.

Game Modes

Sleep Mode:

If the on/off switch 152 (also referred to as the game button) is held down for 2 seconds or more when the game is in wake mode, then the game should go into sleep mode. When the of/off switch 152 is then pressed at a later time, the game goes into the wake mode and is ready for play.

Embodiments of the present invention are currently designed for a single player (Single Player mode).

An embodiment intended for use by one or more players (Multi-Player Mode) will enable communication between racks. These embodiments could include an infrared ("IR") light emitting diode ("LED") and an IR receiver for transmitting data to other game racks. In these embodiments, the IR components could be located on the back of the rack to allow communication between racks. If two players are facing each other, their racks should be oriented back to back, so that the racks' IR components will face each other and enable communication between the racks. The microprocessor will be programmed so that all of the tiles have unique identification codes, and means for identifying each player, so that scoring can be attributed to the appropriate player, and enabling the game to be played by two or more players. In other embodiments, an additional IR LED and IR receiver could be positioned on the sides of the rack to allow communication between racks being played side by side by a single player.

To place the game into Multi-Player Mode from the sleep mode, the on/off switch is depressed for about 2 seconds, and the microprocessor of that rack signals the tiles to place a dash symbol "-" on each of the tiles that are on the rack for the next game. The rack microprocessor would then communicate with the IR receiver to determine if the IR receiver has obtained data from other game racks, and check the position of the on/off switch. If the on/off switch has been pressed, then the rack microprocessor should select a random set of letters for a Main Word from the database, based on the number of tiles on the rack, and send that database entry number out to the other rack(s) through the IR LED. If the game receives a database entry number through the IR receiver, then the microprocessor should select the letters based on that database entry number. If the number of tiles do not match the database entry (for example, one player has 7 tiles on the rack and the other has 6), then each of the tiles should flash the number of tiles that should be placed on the rack (for example: if the database entry received was for a 6 letter word and the rack has 7 tiles, then all 7 tiles should flash 6 to indicate that the player should remove 1 tile from the end.). In multi-player mode, the next word selected for each player should be the next word in the database, rather than a word selected at random. Each player can start their game as soon as the letters have been displayed on the tiles.

Although embodiments of this invention have been described with a certain degree of particularity, it is to be understood that the present disclosure has been made only by the way of illustration, and that numerous changes in construction and arrangement of parts may be resorted to without departing from the spirit and scope of the invention.

TABLE 1

| TYPES OF SIGNALS DISPLAYED DURING A GAME |
|---|
| NEW LETTERS |
| VALID WORD |
| TIME OUT |
| GAME OVER |
| NO SCORE |

We claim:

1. An electronic word game system, the system comprising:

a rack, the rack comprising:

a body having a bottom surface, a front surface, a back surface and a pair of sides, the front surface including a plurality of receptacles therein, the rack body sized to receive a plurality of tiles therein, each receptacle sized to receive one tile of the plurality of tiles therein, each receptacle including a plurality of contacts therein, the contacts further including a means for electronic communication with the plurality of tiles, the rack further comprising a microprocessor, a power switch, a power source, the rack microprocessor, power switch and power source being in electrical communication with each other;

the rack microprocessor comprising:

a means for detecting a presence of a tile within the rack;

a means for determining a location of a tile within the rack;

a means for communicating with the plurality of tiles;

a memory, the memory programmed to include a database of words, each word having a plurality of letters; and a database of instructions for controlling the word game; and wherein the plurality of tiles, each tile comprising:

a body having:

a front surface, a back surface, a plurality of sides connecting the front and back surfaces, the front surface having a display screen and a rim surrounding the display screen;

the body including a plurality of contacts;

a tile microprocessor, the tile microprocessor contained within the tile body and in electronic communication with the display screen and the plurality of contacts;

a printed circuit board in electronic communication with the tile microprocessor; and a means to store electric power to power the display after one of the plurality of tiles, received within the rack, has been removed from the rack.

2. The game system as described in claim 1, wherein the plurality of contacts of the rack and the tile each comprise a grounding contact, a data transmission contact and a power transmission contact.

3. The game system as described in claim 2, wherein when one of the plurality of tiles is placed in the rack receptacle, the rack microprocessor communicates with the tile microprocessor to program the tile display.

4. The game system as described in claim 3, wherein the signals displayed during the game include a NEW LETTERS signal, a VALID WORD signal, a TIME OUT signal, a GAME OVER signal and a NO SCORE signal.

5. The game system as described in claim 2, wherein during the game, at least one of the plurality of rack receptacles is empty.

6. A rack for an electronic word game, the rack comprising:

a body having a bottom surface, a front surface, a back surface and a pair of sides, the front surface including a plurality of receptacles therein, the rack body sized to receive a plurality of tiles therein, each receptacle sized to receive one tile of the plurality of tiles therein, each receptacle including a plurality of contacts therein, the contacts further including a means for electronic communication with the plurality of tiles, the rack further comprising a microprocessor, a power switch, a power source, the rack microprocessor, power switch and power source being in electrical communication with each other;

the rack microprocessor comprising a means for detecting a presence of a tile within the rack;

a means for determining a location of a tile within the rack;

a means for communicating with the plurality of tiles;

a memory, the memory programmed to include a database of words, each word having a plurality of letters; and a database of instructions for controlling the word game.

7. The rack as described in claim 6, wherein the plurality of contacts comprise a grounding contact, a data transmission contact and a power transmission contact.

8. The rack as described in claim 7, further comprising a means for communicating with one or more of a plurality of second racks.

9. The rack as described in claim 8, wherein the means for communicating with the one or more second racks comprises an infrared communication transmitter, the infrared transmitter in electronic communication with the microprocessor.

10. The rack as described in claim 9, wherein the means for communicating with the one or more second racks comprises an wireless communication means, the wireless communication means in electronic communication with the microprocessor.

11. The rack as described in claim 10, further comprising a means for receiving a wireless communication or an infrared communication from the second rack.

12. The rack as described in claim 7, further comprising a speaker, the speaker in electronic communication with the microprocessor.

13. A tile for an electronic word game, the tile comprising:

a body having:

a front surface having a display screen and a display rim surrounding the display screen, a back surface, and a plurality of sides connecting the front and back surfaces;

a plurality of contacts;

a microprocessor contained within the tile body, the microprocessor in electronic communication with the display screen and the plurality of contacts;

a printed circuit board in electronic communication with the microprocessor;

a memory device storing a unique identification code, the identification code received from a second microprocessor associated with a game rack:

wherein the associated game rack comprises a power source and a plurality of contacts, the plurality of rack contacts aligning with the plurality of tile contacts when the tile is placed onto the game rack, the second microprocessor determining the unique identification code for the tile and communicating the unique identification code to the tile by means of the plurality of contacts when the tile is placed onto the game rack and the rack power source providing electric power to the tile by means of the plurality of contacts when the tile is placed onto the game rack; and a capacitor to store the electric power received from the game rack to power the display screen upon removal of the tile from the game rack.

14. The tile as described in claim 13, wherein the display screen comprises a display selected from the group consisting of a Liquid Crystal Display ("LCD"), a light emitting diode ("LED") and an organic light emitting diode ("OLED").

15. The tile as described in claim 14, wherein the display screen comprises a Liquid Crystal Display.

16. The tile as described in claim 13, wherein the tile microprocessor is in electronic communication with the display rim.

* * * * *